United States Patent [19]

Hansen et al.

[11] 4,316,707

[45] Feb. 23, 1982

[54] GEROTOR WITH VALVE PLATE ATTACHED TO ROTOR

[75] Inventors: Gunnar L. Hansen; Christian B. Hansen, both of Nordborg, Denmark

[73] Assignee: Danfoss A/S, Nordborg, Denmark

[21] Appl. No.: 129,176

[22] Filed: Mar. 10, 1980

Related U.S. Application Data

[63] Continuation of Ser. No. 959,746, Nov. 13, 1978, abandoned.

[30] Foreign Application Priority Data

Nov. 22, 1977 [DE] Fed. Rep. of Germany ..... 2752036

[51] Int. Cl.[3] ..... F03C 2/00; F04C 2/10; F04C 15/02

[52] U.S. Cl. ..... 418/60; 418/61 B; 137/625.21

[58] Field of Search ..... 418/60, 61 B; 137/625.21

[56] References Cited

U.S. PATENT DOCUMENTS

| | | | |
|---|---|---|---|
| 3,270,681 | 9/1966 | Charlson | 418/61 B |
| 3,289,542 | 12/1966 | Fikse | 418/61 B |
| 3,561,893 | 2/1971 | Baatrup | 418/61 B |
| 3,598,509 | 8/1971 | Goff et al. | 418/61 B |
| 4,087,215 | 5/1978 | Miller | 418/61 B |

*Primary Examiner*—John J. Vrablik
*Attorney, Agent, or Firm*—Wayne B. Easton

[57] ABSTRACT

The invention relates to a gerotor type of rotary piston machine. In this type of device an externally toothed rotor member is eccentrically offset relative to an internally toothed stator member and in operation these members mesh to form expanding and contracting cells on opposite sides of the line of eccentricity. There is a shaft means for driving the rotor and a distributing valve for feeding and exhausting the cells. The distributing valve, which is normally connected to the drive shaft, is connected to the rotor member for movement therewith adjacent to the rotor and stator member. An annular chamber is formed between the periphery of the distributing valve and the interior of the casing. One set of the distributing ports is formed as ports within the confines of the periphery of the valve. The other set of distributing ports are formed by the periphery of the valve.

5 Claims, 4 Drawing Figures

GEROTOR WITH VALVE PLATE ATTACHED TO ROTOR

This is a continuation application of Ser. No. 959,746, filed Nov. 13, 1978, now abandoned.

The invention relates to a rotary piston machine for liquids, pump or engine, comprising an externally serrated first gear and an internally serrated second gear which surrounds same eccentrically, has one tooth more than same and forms displacement chambers therewith between the teeth, one gear executing gyratory motion with respect to the other at a higher frequency and rotary motion at a lower frequency, and comprising a valve plate which is disposed adjacent the gears, is fixed to the one gear, and has two sets of alternately arranged first control ports each equal in number to the number of teeth of the first gear and communicating with the pressure and suction or low-pressure connection respectively, the said first ports co-operating with second ports which are provided on the other gear and are equal in number to the number of its teeth.

In a known construction, in which the externally serrated first gear rotates and gyrates and the internally serrated second gear is fixed with respect to the housing, a valve plate is used which is connected to the last-mentioned gear, i.e. it is also fixed with respect to the housing. The valve plate has first control ports of substantially parallelogram shape co-operating with triangular second control ports in the externally serrated first gear that open into the root of the teeth. This simplifies the construction of the distributing valve because it is not necessary to couple a rotary slide to the first gear by way of a cardan shaft. In addition, the play that necessarily occurs when using a cardan shaft does not have to be taken into account in the function of the valve. However, it is necessary to provide the first gear with control ports. Further, the control ports are comparatively small and therefor this machine is suitable only for a comparatively low throughput of pressurised liquid.

The invention is based on the problem of providing a rotary piston machine of the aforementioned kind which, with comparable dimensions, can be traversed by larger quantities of pressurised liquid without the occurrence of excessively high throttling losses.

This problem is solved according to the invention in that the valve plate is connected to the externally serrated first gear, projects therebeyond to such an extent that it projects beyond the root of the teeth of the internally serrated second gear in all operating positions, that the first control ports are at least partially disposed in the projecting region and the second control ports are formed by the gaps of the second gear bounded by the root and flanks of the teeth.

In this machine, the valve function is performed on a circle disposed outside the externally serrated first gear. Here, adequate space is available to provide sufficiently large control ports with consequently low losses. The machine can therefore work with larger amounts of liquid than hitherto without incurring higher throttling losses. An engine can therefore be driven faster. Since the gaps between the teeth of the second gear are utilized as second control ports, a corresponding amount of additional machining is saved for one of the gears. Since the second control ports form the lateral boundaries of the displacement chambers, there is also no throttling loss between the control port and the displacement chamber.

It is very favourable if a fixed connecting passage opens into an annular chamber surrounding the valve plate and the first control ports of the one set are each connected to said annular chamber. Since such an annular chamber is in any case available for the eccentric motion of the valve plate, it can also be utilized for the distribution of pressure liquid without additional expenditure.

In this case it is even possible for the first control ports of the one set to be formed by cut-outs extending from the periphery of the valve plate. The result of this is that the throttling resistance at the transition between the annular chamber and the said control ports is a minimum.

The first control ports of the other set can be connected by radial passages to a central chamber of the valve plate into which a fixed connecting passage opens. These radial passages can for example be formed by grooves on the side of the valve plate remote from the gears. Even when the central chamber executes an eccentric motion, there is no difficulty in keeping it in communication with the fixed connecting passage.

Production is considerably simplified if the first control ports and the central chamber pass completely through the valve plate. For example, the valve plate can then be in the form of a simple stamping of which only the two end faces still have to be ground.

With particular advantage, it is provided that between the first control ports of the one set arranged on a circle about the centre of the first gear and those of the other set, narrow and wide webs are provided alternately, of which the narrow webs have a substantially constant width and forming the displacement chamber of smallest volume, substantially cover the associated root of the teeth on the second gear, and the wide webs have an inwardly increasing width and are bounded by arcs which form the displacement chamber of largest volume and substantially coincide with the associated flanks of the second gear. By means of this form for the first control ports one obtains reliable operation with comparatively large tolerances.

Further, the valve plate may be disposed between two identical pairs of gears. The first control ports in the valve plate will then be operative towards both sides. This results in an engine or pump of double capacity. In addition, the valve plate is substantially pressure balanced because the same pressure acts on both sides.

The invention will now be described in more details with reference to Examples illustrated in the drawing, wherein.

Figure 1:
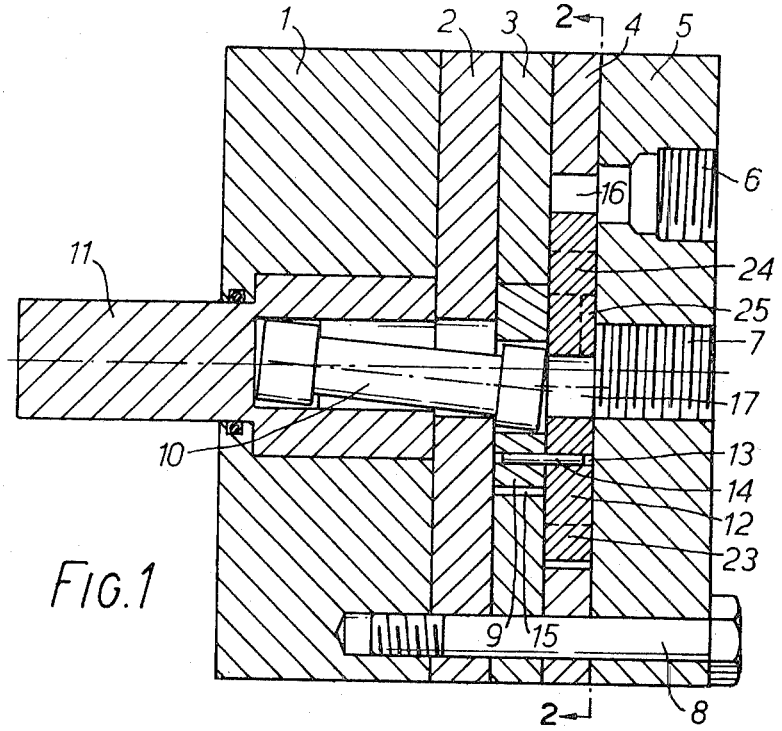
FIG. 1 is a diagrammatic longitudinal section through a rotary piston machine according to the invention.

In the rotary piston machine according to FIG. 1, the housing consists of a bearing block 1, an intermediate plate 2, an internally serrated gear 3, an annular plate 4 and a connecting block 5 comprising screw-threaded connecting conduits 6 and 7. These components are held together by bolts 8. An externally serrated gear 9 engages with the internally serrated gear 3 and is connected by a cardan shaft 10 to a drive or output shaft 11 mounted in the bearing block 1. A valve plate 12 is connected to the gear 9 to rotate therewith, for example by means of pins 14 engaging in holes 13, one of the pins being shown in FIG. 1 when displaced through 90°. Displacement chambers 15 are formed between the gears 3 and 9. The valve plate 12 is externally surrounded by an annular chamber 16 into which the connecting conduit 6 opens. At the middle of the plate there is a central chamber 17 which communicates with the connecting conduit 7.

Figure 2:
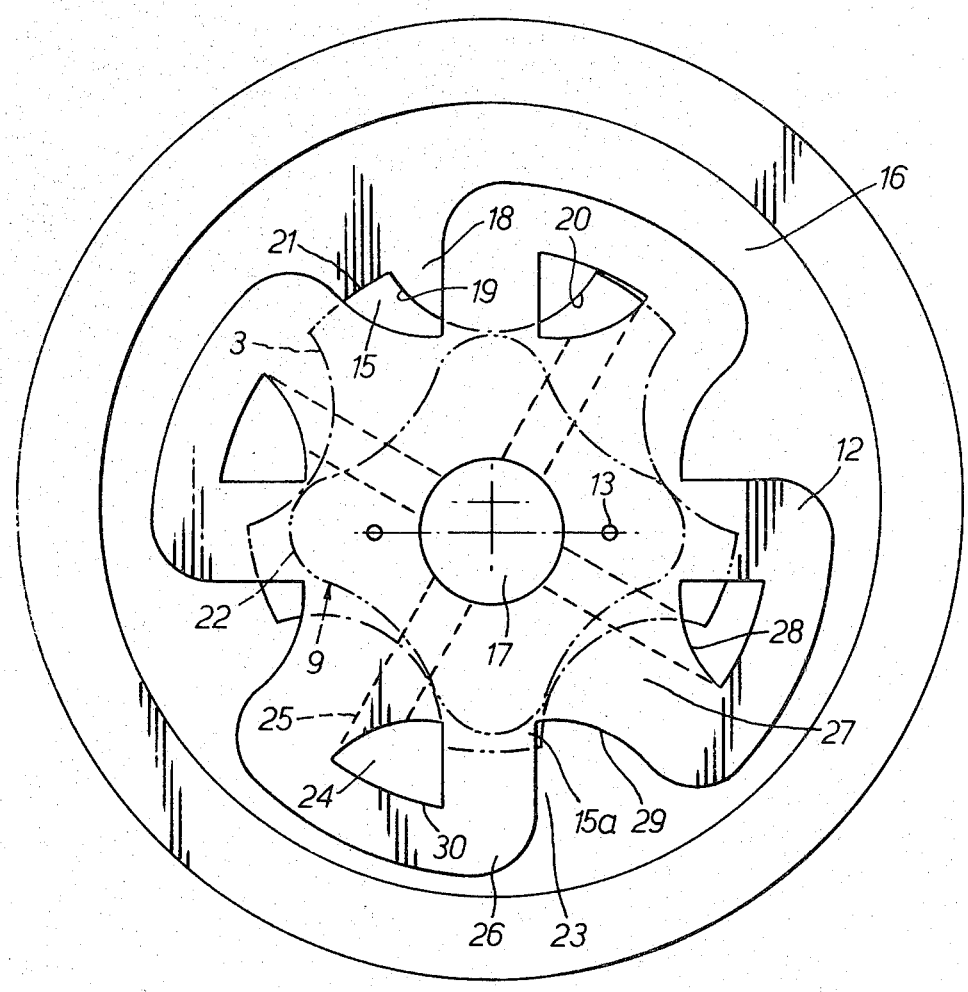
FIG. 2 is an elevation on the line 2—2 in FIG. 1 in a position of smallest volume for the displacement chamber.
Figure 3:
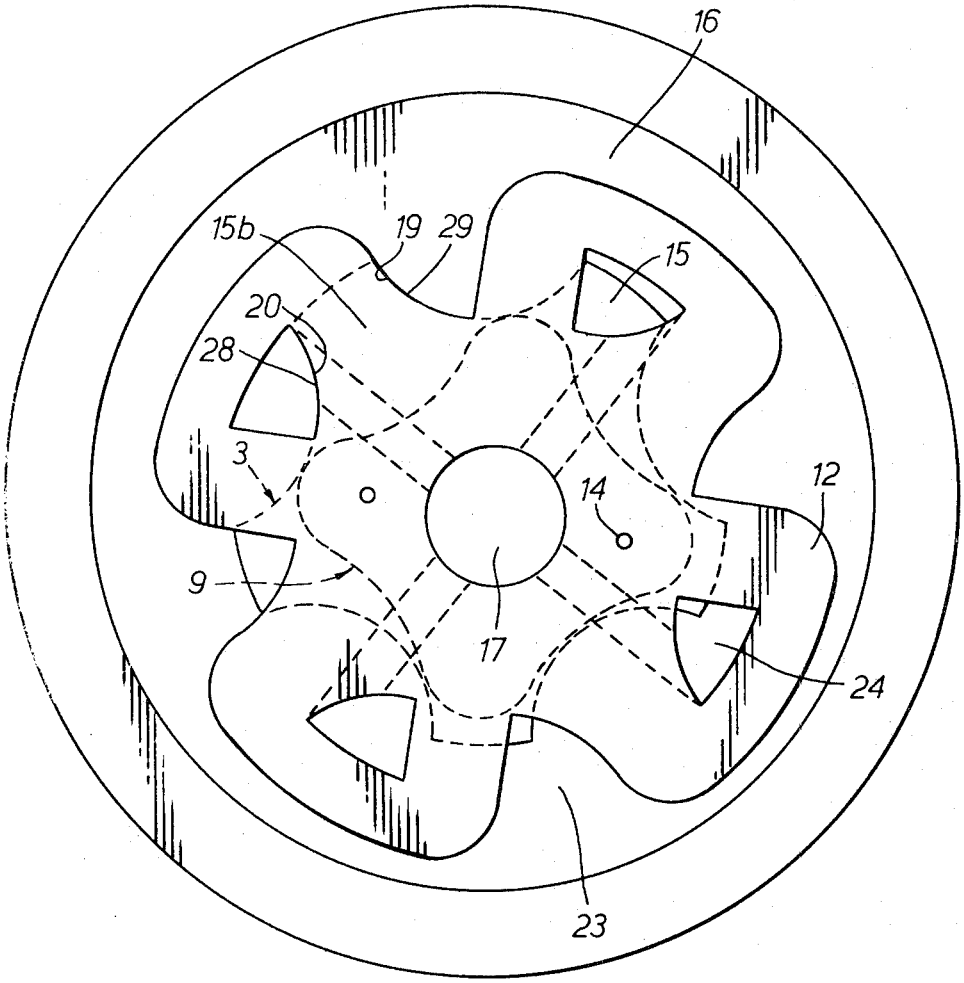
FIG. 3 is a view similar to FIG. 2 in a position of largest volume for the displacement chamber.

It will be evident from FIGS. 2 and 3 that the internally serrated gear 3 has five teeth 18 with corresponding flanks 19 and 20. The teeth are separated from each other by a respective root 21. The externally serrated gear 9 has four teeth 22. The valve plate 12 has two sets of control ports on a circle, namely the control ports 23 which are open towards the annular chamber 16 and control ports 24 which communicate with the central chamber 17 by radial passages 25. The radial passages 25 are formed by grooves in the end face of the valve plate 12 remote from the gears 3 and 9. These control ports 23 and 24 are alternately separated from each other by narrow webs 26 and wide webs 27. The webs 26 have the same width throughout and, in the FIG. 2 position where a displacement chamber 15*a* of smallest volume is provided, substantially cover the root 21 of the teeth. The wide webs 27 are bounded by arcs 28 and 29 and, in the FIG. 3 position where a displacement chamber 15*b* of largest volume is provided, they substantially coincide with the tooth flanks 19 and 20 to both sides of this displacement chamber. In this embodiment, the radially outer limit 30 of the control ports 24 is disposed on a circle which, in the FIG. 2 position, is substantially tangential to the circle defined by the root 21.

It will be evident from FIG. 2 that the two left-hand displacement chambers 15 and the lower displacement chamber 15*a* are partially covered by the control ports 23 whereas the two right-hand displacement chambers 15 communicate with the control ports 24. If, during operation as an engine, the annular chamber 16 is supplied with pressurised liquid, the externally serrated gear 9 commences to turn clockwise, the valve plate 12 executing the same rotary motion whereby the over-control conditions change in such a way that the line of symmetry separating the pressure and low-pressure sides turns counter-clockwise at five times the speed. In the FIG. 3 position, the displacement chamber 15*b* is just changing from the pressure to the low-pressure side, the two right-hand displacement chambers 15 are connected to the central chamber 17 and the remaining two chambers are connected to the annular chamber 16. Consequently the externally serrated gear 9 can continue to turn clockwise. Similar conditions apply in the reverse direction of rotation, i.e. if pressure fluid is supplied by way of the central chamber 17.

Figure 4:
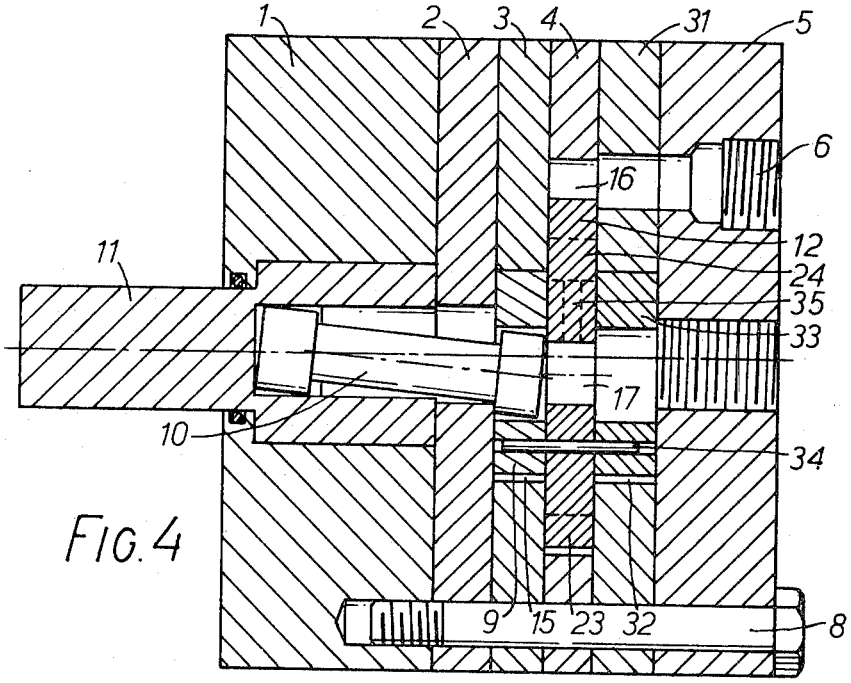
FIG. 4 is a longitudinal section through a modified embodiment.

In the embodiment according to FIG. 4, the same parts are designated with the same reference numerals as in FIG. 1. In addition, there are a further fixed internally serrated gear 31 and an externally serrated gear 33 forming displacement chambers 32 therewith. The gear 33 is connected to turn with the valve plate 12 and gear 9 by means of an extended pin 34. Control ports 23 and 24 have the same form as in the preceding example. They now control displacement chambers 15 and 32 on both sides. Consequently, the pressure loading on the valve plate 12 is symmetrical on both sides so that friction is reduced. In this case radial passages 35 are provided within the valve plate 12.

Departures from the illustrated examples are possible in many directions. For example, the valve plate 12 can be made not only by stamping but also by sintering. The valve plate can also be assembled from two thinner plates, whereby the production of the radial passages 35 is simplified.

What is claimed is:

1. A rotary piston machine comprising a casing having interchangeable fluid inlet and outlet ports, an internally toothed stator member and an eccentrically disposed externally toothed rotor member in meshing engagement, said rotor member having rotational movement about its own axis and orbital movement about the axis of said stator member with the teeth of said members intermeshing in sealing engagement to form a group of expanding cells on one side of a rotating line of eccentricity and a group contracting cells on the other side of said line during relative movement between said members, drive shaft means in said casing connected to said rotor member, a valve plate attached to one side of said rotor member and having a sliding and abutting engagement with said stator member in a transversely extending plane, first and second sets of circumferentially and alternately arranged porting means in said plate for sequential fluid engagement with said cells, said first set of porting means being in constant fluid communication with a first one of said ports and a first group of said cells, said second set of porting means being in constant fluid communication with the second one of said ports and a second group of said cells, a generally annularly shaped recess formed between the periphery of said valve plate and the interior of said casing having fluid communication with said first one of said ports and said first set of porting means, said first set of porting means having flow controlling valving edges in said plane which cyclically intersect said cells and are formed by said periphery of said valve plate.

2. A rotary piston machine according to claim 1 wherein said second one of said ports is generally coaxial relative to said drive shaft means, said valve plate at least partially defining passage means extending between said second one of said ports and said second set of said porting means.

3. A rotary piston machine according to claim 2 wherein said passage means of said valve plate extend radially relative to said rotor and between said valve plate and said casing.

4. A rotary piston machine according to claim 2 wherein said passage means of said valve plate extend radially relative to said valve plate internally thereof.

5. A rotary piston machine comprising a casing having interchangeable fluid inlet and outlet ports, first and second axially spaced gear sets each including toothed stator member and an eccentrically disposed externally toothed rotor member in meshing engagement, each said rotor member having rotational movement about its own axis and orbital movement about the axis of said stator member of the same set gear set with the teeth of said members intermeshing in sealing engagement to form a group of expanding cells on one side of a rotating line of eccentricity and a group contracting cells on the other side of said line during operation of said gear sets, drive shaft means in said casing connected to said rotors, a valve plate attached to and between said rotor members and having a sliding and abutting engagement with both said stator members in axially spaced transversely extending places, first and second sets of circumferentially and alternately arranged porting means in said plate for sequential fluid engagement with said cells, said first set of porting means being in constant fluid communication with a first one of said ports and a first group of said cells, said second set of porting means being in constant fluid communication with the second one of said ports and a second group of said cells, a generally annularly shaped recess formed between the periphery of said valve plate and the interior of said casing having fluid communication with said first one of said ports and said first set of porting means, said first set of porting means having flow controlling valving edges in both of said planes which cyclically intersect said cells and are formed by said periphery of said valve plate.

* * * * *